US006407518B2

(12) United States Patent
Sakamoto et al.

(10) Patent No.: US 6,407,518 B2
(45) Date of Patent: Jun. 18, 2002

(54) MOIRE-REDUCED COLOR DISPLAY DEVICE INCLUDING A COLOR CATHODE RAY TUBE

(75) Inventors: Hirotsugu Sakamoto, Chiba; Hiroshi Sasaki, Mobara; Kenichi Watanabe, Isumi; Shinichi Kato, Mobara, all of (JP)

(73) Assignees: Hitachi, Ltd., Tokyo; Hitachi Device Engineering Co., Ltd., Mobara, both of (JP)

( * ) Notice: Subject to any disclaimer, the term of this patent is extended or adjusted under 35 U.S.C. 154(b) by 0 days.

(21) Appl. No.: 09/797,721

(22) Filed: Mar. 5, 2001

(30) Foreign Application Priority Data

Mar. 3, 2000 (JP) ..... 2000-058269

(51) Int. Cl.[7] ..... G09G 1/04

(52) U.S. Cl. ..... 315/370; 315/386; 348/806; 348/807

(58) Field of Search ..... 348/806, 807; 315/386, 371, 370

(56) References Cited

U.S. PATENT DOCUMENTS 5,959,414 A * 9/1999 Yoshida et al. ..... 315/382

* cited by examiner

*Primary Examiner*—David Vu
(74) *Attorney, Agent, or Firm*—Antonelli, Terry, Stout & Kraus, LLP

(57) ABSTRACT

A color display device includes a color cathode ray tube having a phosphor screen, a color selection electrode and an electron gun for projecting plural in-line electron beams toward the phosphor screen, a deflection device for deflecting the electron beams horizontally and vertically, an electron beam correction apparatus including a correction coil wound around the tube axis, a deflection circuit for driving the deflection device, and an electron beam correction circuit for supplying to the electron beam correction apparatus a generally rectangular-wave signal having a period equal to two times a period of the vertical deflection of the electron beams and in synchronism with the vertical deflection of the electron beams.

2 Claims, 5 Drawing Sheets

MOIRE-REDUCED COLOR DISPLAY DEVICE INCLUDING A COLOR CATHODE RAY TUBE

BACKGROUND OF THE INVENTION

The present invention relates to a color display device employing a color cathode ray tube, and in particular to a color display device capable of suppressing occurrence of moire while retaining good focus characteristics of a color cathode ray tube.

As color cathode ray tubes for use in color display devices such as a color TV receiver and a color display monitor for a terminal of office automation equipment, color cathode ray tubes are widely used which utilizes a shadow mask as its color selection electrode. The shadow mask type color cathode ray tube includes a vacuum envelope comprising a generally rectangular panel portion, a generally cylindrical neck portion and a funnel portion for connecting the panel portion and the neck portion together, a phosphor screen containing a large number of dot-shaped or stripe-shaped phosphor picture elements and formed on the inner surface of the panel portion, an electron gun housed within the neck portion for projecting three in-line electron beams, and a shadow mask fixed to a mask frame in a closely spaced relationship from the phosphor screen within the vacuum envelope, and having a large number of electron beam-transmissive apertures so as to serve as a color selection electrode.

The shadow mask type color cathode ray tube is equipped with a deflection device comprising horizontal and vertical deflection coils combined with a ferromagnetic yoke and mounted around the transition region between the neck portion and the funnel portion, is also equipped with a magnet assembly around the neck portion for color purity correction and beam centering. The color display device is made up of the shadow mask type color cathode ray tube, a deflection circuit for driving the deflection device and a circuit for driving the color cathode ray tube.

The electron beams projected from the electron gun are deflected in horizontal and vertical directions by the deflection device, then pass through electron beam-transmissive apertures in the shadow mask serving as the color selection electrode and then impinge upon the intended phosphor picture elements to form an image on the phosphor screen.

The above-explained color display device has a disadvantage that the so-called moire occurs at the right and left sides of the phosphor screen of the color cathode ray tube during its operation and it degrades the quality of a displayed image. Such moire is pronounced especially in the high-definition color display device.

Moire is caused by a periodic appearance of alternate light and dark portions produced depending upon positional relationship between the electron beams and the phosphor picture elements, and is perceived as stripes on the phosphor screen and therefore degrades the quality of the display. It is known that, the smaller the vertical diameter of the electron beam spot, that is, the minor axis of the electron beam spot is vertical, the more pronounced the moire.

FIG. 5 is a front view of the panel portion of the color cathode ray tube of the color display device, and shows the shapes of electron beam spots at various positions on the phosphor screen when an image is displayed on the phosphor screen. In FIG. 5, the phosphor screen 2 of the panel portion 1 is divided into three regions (zones) of a central region (hereinafter a central zone) 3, left and right regions (hereinafter left and right zones) 4,5. Respective zones will be represented by clock positions.

The center beam spot 6 at the center of the central zone 3 has a major axis in the vertical direction and a somewhat vertically elongated shape, the top and bottom spots 7, 8 at the 12 and 6 o'clock positions are more elongated in the vertical direction, but the right and left spots 10, 9 at the 3 and 9 o'clock positions are horizontally elongated, that is, they have the major axes in the horizontal direction.

As is apparent from FIG. 5, the right and left electron beam spots 10, 9 at the 3 o'clock and 9 o'clock positions have vertical diameters smaller than those of the electron beams in the remaining positions, and consequently, the moire is pronounced in the areas corresponding to the right and left zones 5 and 4.

A conventional measure against such moire is such that the entire raster is moved alternately upward and downward on successive fields by moving the electron beam path a small distance alternately upward and downward on successive fields such that light portions of one field are superimposed on dark portions of the next field, and vice versa, and consequently, moire is not visually perceived.

A concrete method for the above conventional measure is to superimpose a moire-correcting rectangular current on vertical deflection current flowing through the vertical deflection coil of the deflection device on every alternate field so as to move the entire raster alternately upward and downward.

The above conventional method is expected to provide some effects for eliminating moire compared with the case where such a method is not utilized. However, this method moves the raster alternately upward and downward parallel with the vertical sides of the raster on successive fields to make the moire imperceptible to the eye, and consequently, this method deteriorates focus characteristics at the central zone which is the most important area for a display, and this is a fatal problem other than moire, and therefore there is a demand for a further measure against moire in the color display device.

SUMMARY OF THE INVENTION

It is an object of the present invention to provide a superior color having good display characteristics by solving the above problems.

The following describes a representative configuration of the present invention for achieving the above object.

In accordance with an embodiment of the present invention, there is provided a color display device comprising: a color cathode ray tube including a phosphor screen, a color selection electrode closely spaced from the phosphor screen and an electron gun for projecting plural in-line electron beams toward the phosphor screen; a deflection device mounted around the color cathode ray tube and including a horizontal deflection coil and a vertical deflection coil for deflecting the plural in-line electron beams horizontally and vertically, respectively; an electron beam correction apparatus mounted around the color cathode ray tube and including a correction coil wound around a tube axis of the color cathode ray tube; a deflection circuit for driving the horizontal and vertical deflection coils; and an electron beam correction circuit for supplying to the electron beam correction apparatus a generally rectangular-wave signal having a period equal to two times a period of the vertical deflection of the plural in-line electron beams and in synchronism with the vertical deflection of the plural in-line electron beams.

BRIEF DESCRIPTION OF THE DRAWINGS

In the accompanying drawings, in which like reference numerals designate similar components throughout the figures, and in which.

DETAILED DESCRIPTION OF THE PREFERRED EMBODIMENTS

Now the embodiments of the present invention will be explained in detail by reference to the drawings.

Figure 1:
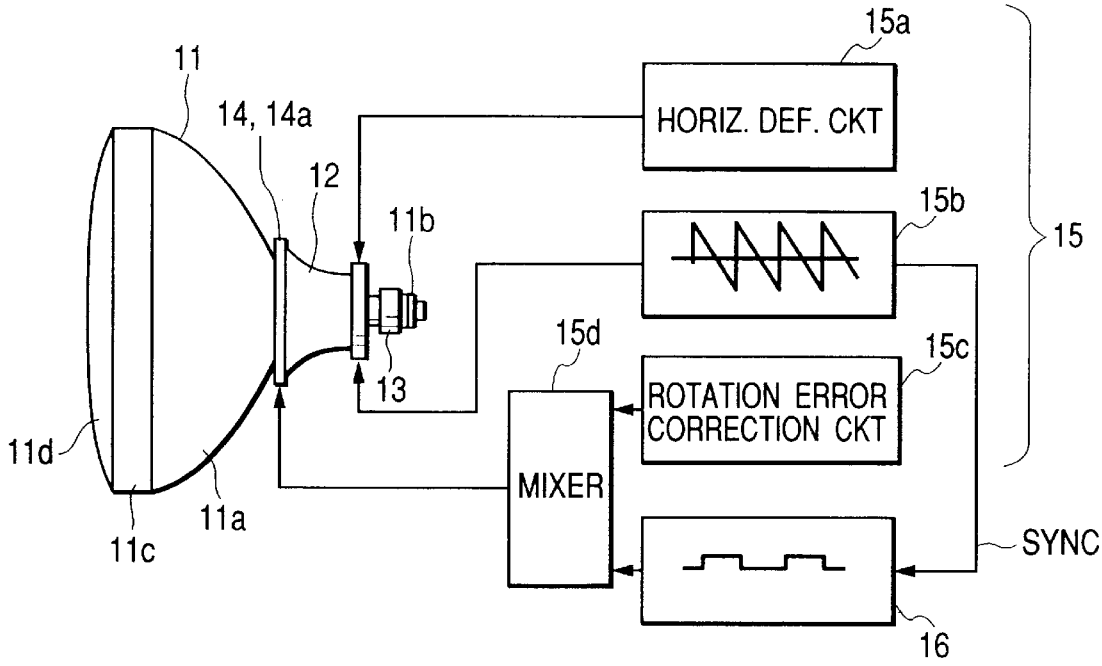
FIG. 1 is a block diagram for explaining an overall configuration of an embodiment of a color display device in accordance with the present invention.

FIG. 1 is a block diagram for explaining an overall configuration of an example of a color display device in accordance with the present invention. In FIG. 1, reference numeral 11 denotes a color cathode ray tube to be described in detail subsequently, and reference numeral 12 denotes a deflection device comprising horizontal and vertical deflection coils combined with a ferromagnetic yoke and mounted around the transition region between a funnel portion 11*a* and a neck portion 11*b* of the color cathode ray tube 11. The deflection device 12 will be described in detail subsequently.

In FIG. 1, reference numeral 13 denotes a magnet assembly mounted around the neck portion 11*b*, reference numeral 14 denotes a beam correction apparatus mounted at the front end of the deflection device 12, that is, the side of the deflection device 12 facing a phosphor screen 11*d* of a panel portion 11*c* of the color cathode ray tube 11. A correction coil 14*a* wound around the tube axis and included in the beam correction apparatus 14 is hereinafter referred to as a third coil, where the horizontal deflection coil and the vertical deflection coil are counted as first and second coils, respectively.

Reference numeral 15 denotes a first driving circuit serving as a deflection circuit. The first driving circuit 15 comprises a horizontal deflection circuit 15*a*, a vertical deflection circuit 15*b*, a rotation correction circuit 15*c*, and a mixer 15*d*. The horizontal deflection circuit 15*a* and the vertical deflection circuit 15*b* are connected to the horizontal deflection coil and the vertical deflection coil, respectively.

The rotation correction circuit 15*c* is connected to the third coil 14*a* included in the beam correction apparatus 14 via the mixer 15*d* and flows a specified current through the third coil 14*a* so as to rotate the raster on the phosphor screen 11*d* on the tube axis. Reference numeral 16 denotes a second driving circuit which is also connected to the third coil 14*a* included in the beam correction apparatus 14 via the mixer 15*d*.

The second circuit 16 generates a generally rectangular-wave current in synchronism with a sync signal of the vertical deflection current supplied to the vertical deflection coil from the vertical deflection circuit 15*b*, and supplies the generally rectangular-wave current to the third coil 14*a* included in the beam correction apparatus 14.

Figure 2:
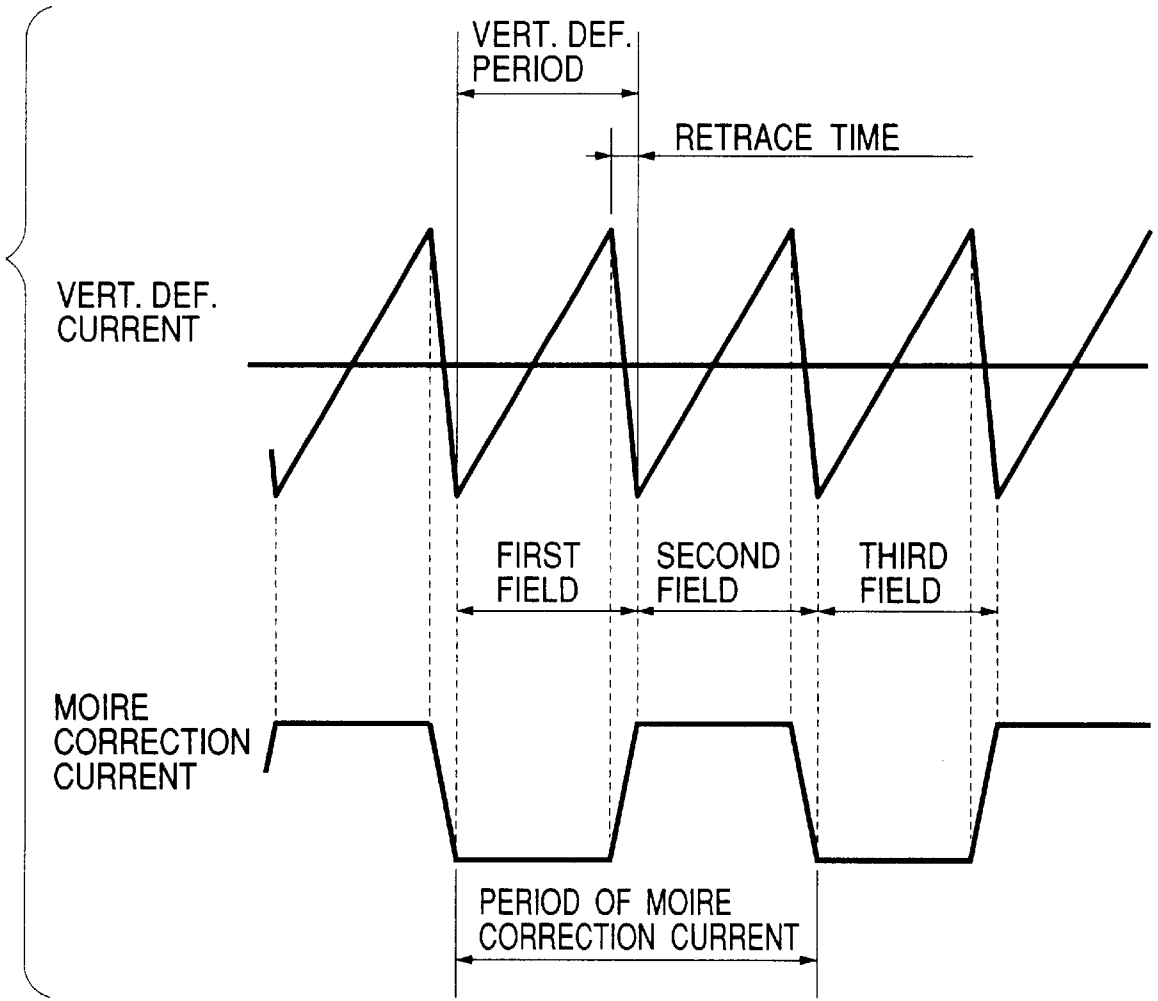
FIG. 2 is a time chart illustrating a moire correction current in the color display device of the present invention.

As shown in FIG. 2, the generally rectangular-wave current has the period of two times the period of the vertical deflection current, and is synchronized with the vertical deflection current. Suppose the frequency of the vertical deflection is 80 Hz, for example, then the frequency of the generally rectangular-wave current is 40 Hz.

Figure 3:
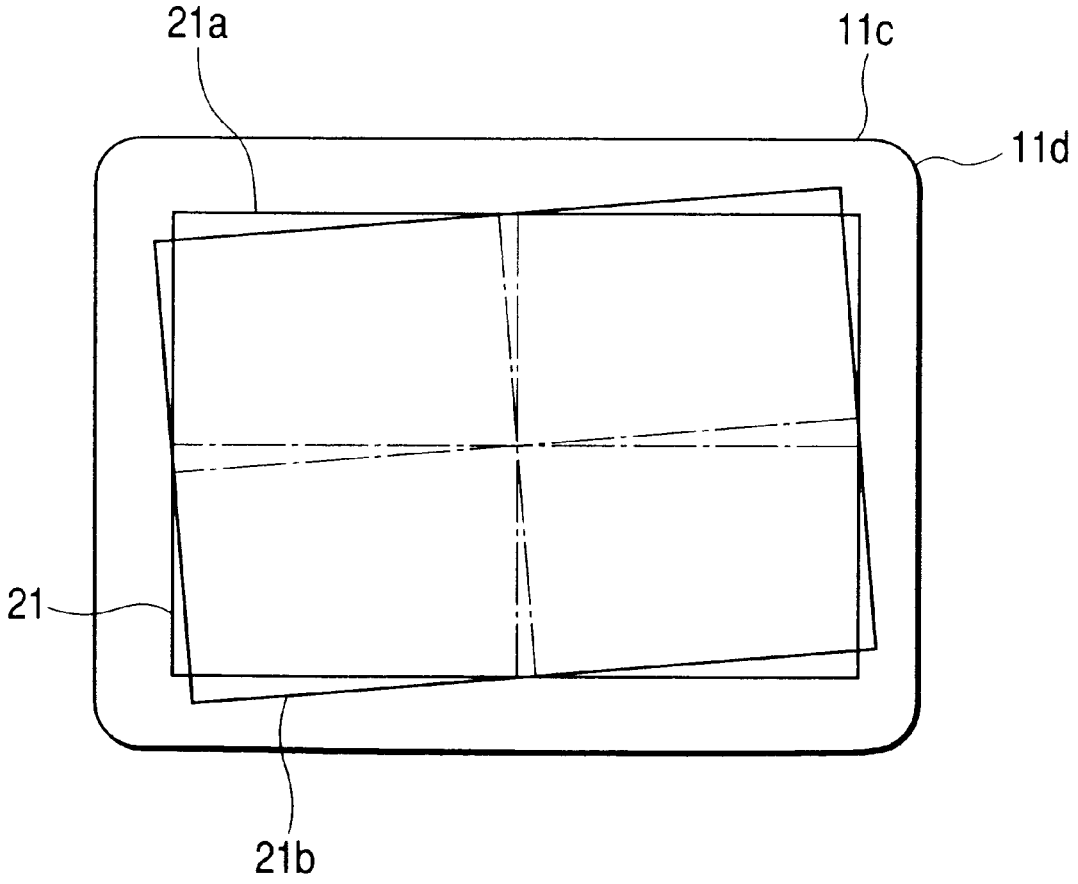
FIG. 3 is an illustration for explaining movement of the raster on the phosphor screen of the color display device of the present invention.

As shown in FIG. 3, when the generally rectangular-wave current is supplied to the third coil 14*a* included in the beam correction apparatus, the raster 21 on the phosphor screen lid of the first field is positioned at a position indicated by reference numeral 21*a*, then the raster 21 of the second field is rotated on the tube axis to a position indicated by reference numeral 21*b*, and next the raster 21 of the third field is rotated back to the position indicated by reference numeral 21*a*, . . . , this cycle is repeated with a period of two times that of the vertical deflection. A difference in distance of a position in the raster between successive fields decreases as the position approaches the center of the raster, in other words, the nearer to the center of the raster, the smaller the movement of the beam spot due to the rotation of the raster. Consequently, occurrence of moire is sufficiently suppressed by the appropriate amount of movement of the electron beam spots at the peripheries of the raster, and the focus characteristics at the central zone of the raster are sufficiently secured because movement of the electron beam at the central zone is sufficiently small.

Figure 4:
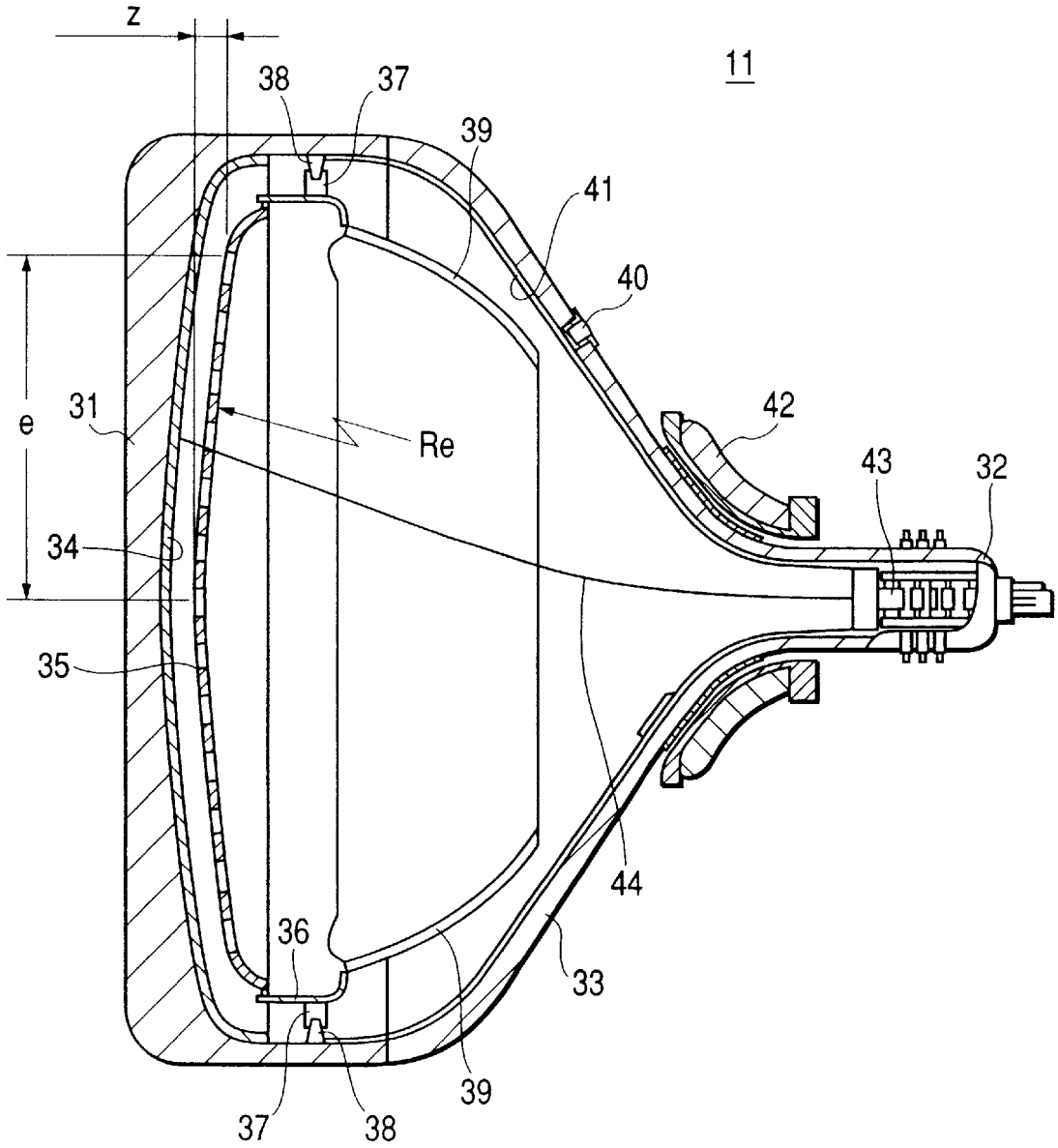
FIG. 4 is a cross-sectional view of an example of a shadow mask type color cathode ray tube used for the color display device of the present invention.

FIG. 4 is a longitudinal cross-sectional view of an example of a shadow mask type color cathode ray tube used for the color display device in accordance with the present invention for explaining its overall structure. In FIG. 4, reference numeral 31 denotes a panel portion, 32 is a neck portion, 33 is a funnel portion, 34 is a phosphor film, 35 is shadow mask having a large number of electron beam-transmissive apertures therein and serving as a color selection electrode, which is disposed coaxially with the phosphor film 34 and is spaced a predetermined distance from the phosphor film 34. Reference numeral 36 denotes a mask frame which holds the shadow mask 35 and others with a structure to be described subsequently.

Figure 5:
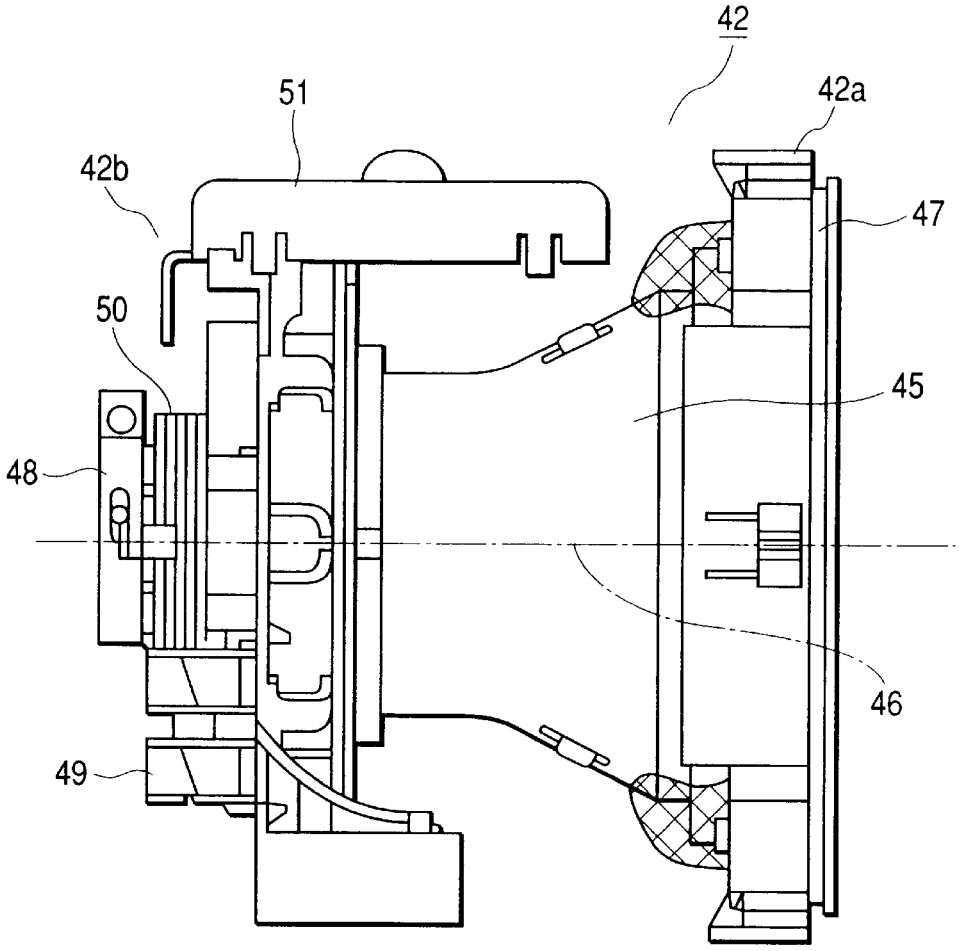
FIG. 5 is a schematic side view of an example of the deflection device used for the color display device of the present invention.
Figure 6:
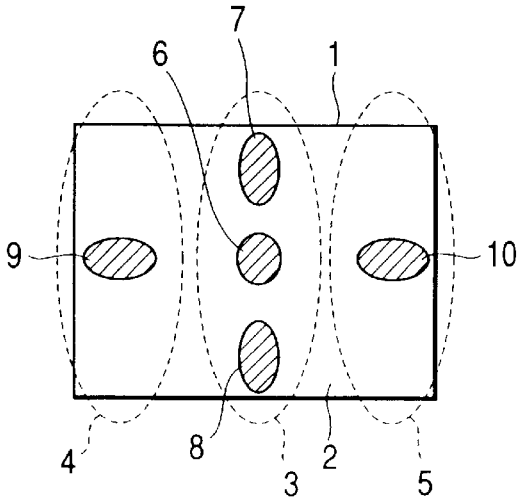
FIG. 6 is an illustration of shapes of the electron beam spots at various positions on the phosphor screen of the color cathode ray tube in the color display device.

Reference numeral 37 are springs, 38 are panel pins, 39 is a magnetic shield, 40 is an anode button, 41 is an internal conductive coating, 42 is a deflection yoke for deflecting electron beams horizontally and vertically, and example of the deflection device 42 is shown in FIG. 5.

Reference numeral 43 is an electron gun for emitting three in-line electron beams 44 (a center electron beam and two side electron beams).

The mask frame 36 having the shadow mask 35 and the magnetic shield 39 fixed thereto is mounted on the panel pins 38 via the springs 37 within a bulb comprised of the panel portion 31 having the phosphor film 34 on its inner surface and the funnel portion 33, then the panel portion 31 and the funnel portion 33 are joined together with fused frit glass, then the electron gun 43 is sealed into the neck portion 32, and the envelope formed of the panel portion 31, the funnel portion 33 and the neck portion 32 is vacuum-sealed.

The electron beams 44 emitted from the electron gun 43 are deflected horizontally and vertically by the deflection yoke 42 mounted around the transition region between the neck portion 32 and the funnel portion 33, and then pass through electron beam-transmissive apertures in the shadow mask 35 serving as the color selection electrode and impinge upon the phosphor film 34 to form images.

As color TV receivers and color display monitors of a flat-screen type spread recently, there is a tendency for the faceplate (the panel glass) to be made flat in color cathode ray tubes used for those.

FIG. 4 shows an example of a shadow mask type color cathode ray tube of the flat-screen type used for the color display device of the present invention. In FIG. 4, the outer surface of the panel portion 31 is approximately flat, and its inner surface is concavely curved. The shadow mask 35 is fabricated by press-forming a shadow mask blank into a shape having a desired curvature conforming to the inner surface of the panel portion 31.

The reason why the inner surface of the panel portion 31 and the shadow mask 35 are curved irrespective of the approximately flat outer surface of the panel portion 31 is that a method of fabricating the shadow mask 35 by a press-forming technique is simple and the cost of the shadow mask 5 is low.

A major surface of the shadow mask 35 including an apertured area formed with a large number of electron beam-transmissive apertures is approximately rectangular, has different radiuses of curvature along the major axis in the horizontal direction, the minor axis in the vertical direction and the diagonals, of the major surface, respectively. This is intended to obtain the compatibility of creation of a sense that a picture on the screen of the color cathode ray tube is flat with the maintenance of mechanical strength of the formed shadow mask.

The curvature of the shadow mask 35 in the this example is aspheric, and the radiuses of curvature of the shadow mask 35 decrease gradually with increasing distance from the center of the major surface of the shadow mask 35 toward the peripheries of the major surface, along the major axis, the minor axis and the diagonals of the major surface, respectively. The radius Rx of curvature along the major axis varies from 1450 mm to 1250 mm, the radius Ry of curvature along the minor axis varies from 2000 mm to 1300 mm, and the radius Rd of curvature along the diagonals varies from 1600 mm to 1250 mm.

The radius of curvature of this aspheric shadow mask can be defined as the following equivalent radius Re of curvature:

$$Re=(z^2+e^2)/(2z),$$

where e (mm) is a distance between the center of the major surface of the shadow mask and an arbitrary peripheral position of the major surface, measured perpendicularly to the tube axis, and z (mm) is a distance between the arbitrary peripheral position and a plane passing through the center of the major surface and perpendicular to the tube axis.

As described above, even if the radius along the major axis is somewhat smaller than that along the minor axis, this does not impair the sense that a picture on the screen of the color cathode ray tube is flat, and the equivalent radius of curvature equal to or more than 1250 mm is sufficient for the purpose.

FIG. 5 is a schematic side view of an example of a deflection device used for the color display device of the present invention. In FIG. 5, the deflection device 42 includes horizontal and vertical deflection coils, a funnel-shaped yoke 45 made of ferromagnetic material housing the horizontal and vertical deflection coils, and the beam-correction apparatus 47 having the third coil 14*a* (beam correction coil, not shown) wound around the axis 46 of the deflection device 42 and disposed at the phosphor screen-side end 42*a* of the deflection device 42.

Provided on the neck portion-side end 42*b* of the deflection device 42 are a clamping band 48 for clamping the deflection device 42 around the neck portion, a magnet assembly 49 for color purity adjustment and beam centering, a beam correction coil 50, and a terminal cover 51 disposed at the top of the deflection device 42.

The present invention is not limited to the above embodiments, but various changes and modifications can be made therein without departing from the spirit and scope of the invention as defined in the appended claims.

As described above, the present invention moves the right and left side portions of the raster an appropriate distance upward and downward with suppressing movement of the central portion of the raster, thereby eliminating problematic moire at the peripheries of the raster while securing good focus at the central portion of the raster, and consequently, the present invention provides the excellent color display device excellent in focus characteristics and free from moire.

What is claimed is:

1. A color display device comprising:

a color cathode ray tube including a phosphor screen, a color selection electrode closely spaced from said phosphor screen and an electron gun for projecting plural in-line electron beams toward said phosphor screen;

a deflection device mounted around said color cathode ray tube and including a horizontal deflection coil and a vertical deflection coil for deflecting said plural in-line electron beams horizontally and vertically, respectively;

an electron beam correction apparatus mounted around said color cathode ray tube and including a correction coil wound around a tube axis of said color cathode ray tube;

a deflection circuit for driving said horizontal and vertical deflection coils; and an electron beam correction circuit for supplying to said electron beam correction apparatus a generally rectangular-wave signal having a period equal to two times a period of said vertical deflection of said plural in-line electron beams and in synchronism with said vertical deflection of said plural in-line electron beams.

2. A color display device according to claim 1, wherein said electron beam correction apparatus is attached to a phosphor screen-side end portion of said deflection device.

* * * * *